United States Patent [19]

Key

[11] 4,036,185

[45] July 19, 1977

[54] ENERGY-EFFICIENT VALVE GEAR

[76] Inventor: Edward H. Key, 910 E. Illinois St., Wheaton, Ill. 60187

[21] Appl. No.: 675,613

[22] Filed: Apr. 9, 1976

[51] Int. Cl.[2] ..... F01L 1/30

[52] U.S. Cl. ..... 123/90.25; 74/54; 123/90.26; 123/90.27; 123/90.39

[58] Field of Search ..... 74/53, 54; 123/90.25, 123/90.26, 90.27, 90.41, 90.39, 90.1

[56] References Cited

U.S. PATENT DOCUMENTS

| | | | |
|---|---|---|---|
| 1,503,384 | 7/1924 | Sewell | 123/90.25 |
| 3,572,299 | 3/1971 | Lester | 123/90.26 |
| 3,626,469 | 12/1971 | Ashley | 123/90:25 |

*Primary Examiner*—Carroll B. Dority, Jr.
*Assistant Examiner*—Daniel J. O'Connor
*Attorney, Agent, or Firm*—Philip D. Freedman

[57] ABSTRACT

A valve train comprises a cylinder head and poppet valve thereon, a valve-actuating rocker platen pivotally mounted on the cylinder head by means of a pivot member so that the platen may pivot between positions on either side of the member, a valve connected to one end of the rocker platen for movement of the valve simultaneously with movement of the rocker platen between the rocker platen positions, and actuator means for moving the rocker platen between the positions thereby positively moving the valve between its open position and its closed position, the actuator means comprising a rotary cam means and cooperating follower pivotally mounted and spring biased into engagement with the rocker platen and engaged with the cam means for pivoting the rocker arm upon rotation of the cam means, the follower comprising a pivotally mounted casing, spring biased plunger means on the casing, and biased to a roller bearing on and adapted to ride over the rocker platen, thereby moving the platen between the positions, the roller rotatably attached to the pivoted plunger means at the roller center rotation. An improvement to this valve train is provided wherein the platen is pivotally mounted at a point above the surface on which the roller rides and further, the radius of the roller equals the vertical distance from the platen to the point of pivotal mounting so that the center of rotation of the roller passes through the axis of the pivot point of the platen. The valve-actuating rocker platen may comprise two intersecting arc-shaped sections, the platen so constructed that each of the sections has the pivot point of the pivot casing as its center of curvature when the spring-biased plunger means is engaged with the respective section.

2 Claims, 6 Drawing Figures

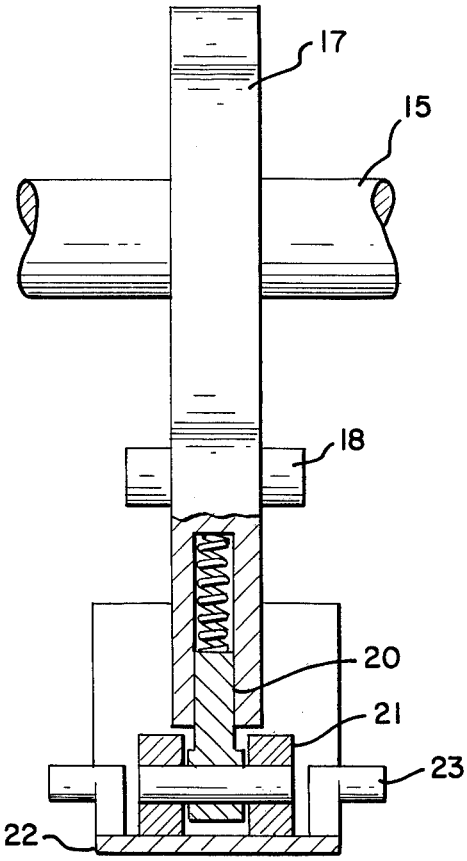
Fig. 3
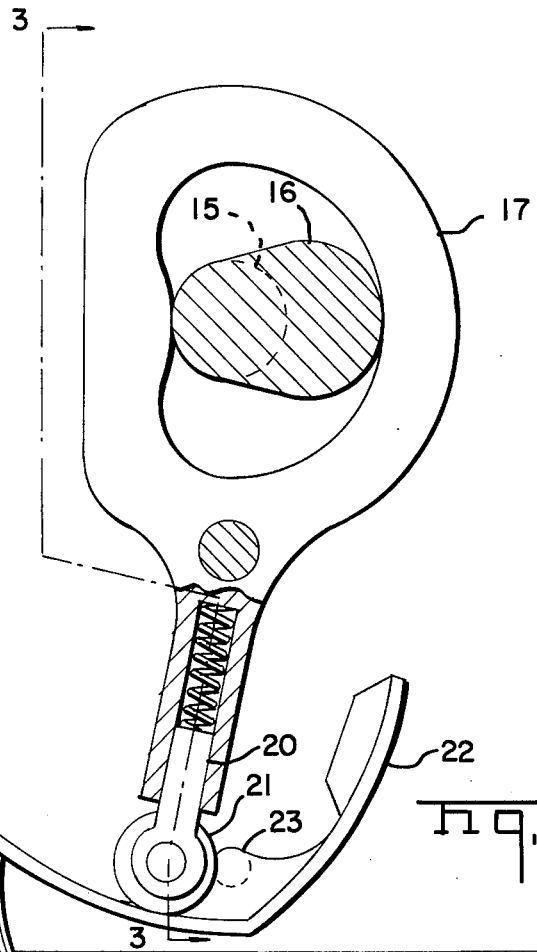
Fig. 2
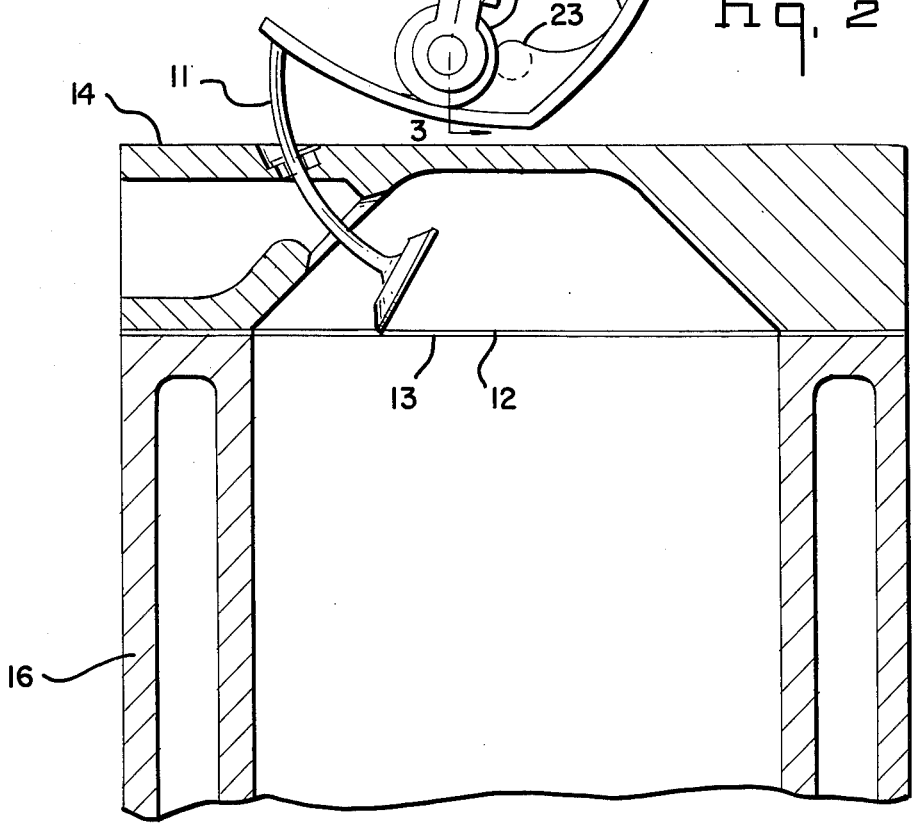

ENERGY-EFFICIENT VALVE GEAR

This invention relates to a valve gear, and particularly to an improved valve gear for use in an internal combustion engine.

Generally, internal combustion engines are provided with a cam shaft which is operated from the engine's crankshaft which in turn drives a series of intake and exhaust valves. In the past the cam shaft has been located longitudinally and below the engine; the shaft will have connecting means between a series of cams and the intake and exhaust valves. In order to provide a more efficient valve operating mechanism, engine designers have changed the mounting of the cam shaft of some engines onto the top of the cylinder head. This position reduces the mass of the engine and the valveactuating mechanisms by eliminating the pushrods and their associated parts. Another design advance has been to utilize desmodromic valve mechanisms whereby a double cam provides both positive and closing of the valve.

Previous problems associated with this type of valve arrangement have included high costs which are the results of the extremely high tolerances required to insure complete closure of the valves. Further, proposed lay-outs of desmodromic valve-actuating mechanisms have seriously limited the serviceability of the engine and have rendered such designs unsuited for wide commercial usage.

Ashley, U.S. Pat. No. 3,626,469, relates to an improved positivelyoperated valve gear that is designed to provide a valve train that does not require frequent adjustment and may be built with relatively loose tolerances. The Ashley invention provides a valve train for an overhead camshaft engine that utilizes rocker arms for transmitting motion between the cam and the valve for both opening and closing the valves. As pointed out in that patent, such an arrangement permits a greater latitude in valve placement. In many conventional types of valve gear arrangement, a keeper is carried by the upper end of the stem of the poppet valves. In a conventional engine these keepers transmit an opening or closing force to the valve. The valve closing spring operates through these keepers so that the valve is held in its closed position. The Ashley patent points out that the use of rocker arms for transmitting motion to the valves eliminates the problems of assembly and disassembly of such prior conventional systems.

Finally, Ashley points out that with the use of rocker arms it may be possible that the required pieces may be stamped rather than cast or forged, thus reducing the cost of the components and in many instances permitting a weight savings.

The Ashley invention is described as a positive valve gear for an internal combustion engine, comprising a valve, a rocker arm, a pivot member, a pair of spaced oppositelyextending bearing portions, means for positively connecting the rocker arm to the valve, and operating means for moving the rocker arms between position. The pivot member supports the rocker arm and has a shank portion adapted to be affixed to an associated component of the engine. The bearing portions extend substantially perpendicular to the shank portion. The rocker arm defining bearing surfaces are in engagement with the pivot member bearing portions so that the rocker arm is supported upon the pivot member for pivotal movement between a valve opening position and a valve closing position. The bearing surfaces of the rocker arm engage the pair of spaced oppositely-extending bearing portions. The operating means comprises a rotary cam and a cooperating follower carried by the rocker arm and engaged with the cam for pivoting the rocker arm upon rotation of the cam. At least one of the follower means is spring-biased into an engagement with the cam and is fixed to the rocker arm and engages the pivot member bearing portions opposite to the side engaged by the rocker arm bearing surfaces.

One object of the present invention is to provide an improved valve mechanism of this general type. It has been found that an improved valve mechanism is provided having structural features as will be described in detail below.

The following is a brief description of the drawings.

FIG. 2 is a front elevation of the improved energyefficient valve gear and valve train, and FIG. 3 is a side elevation of the same.

Figure 1:
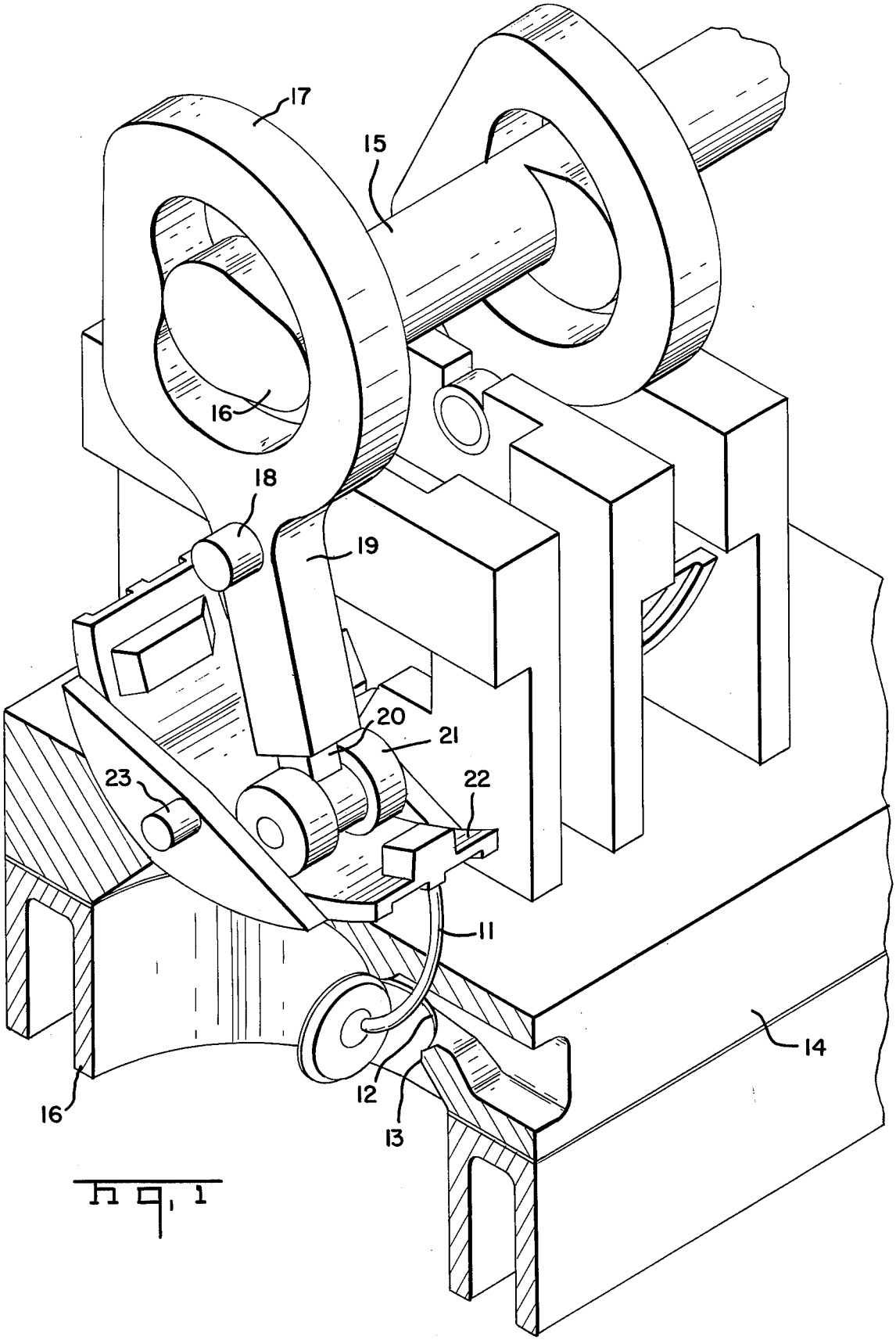
FIG. 1 is a perspective view of the improved energyefficient valve gear of the present invention and associated valve train.
Figure 6:
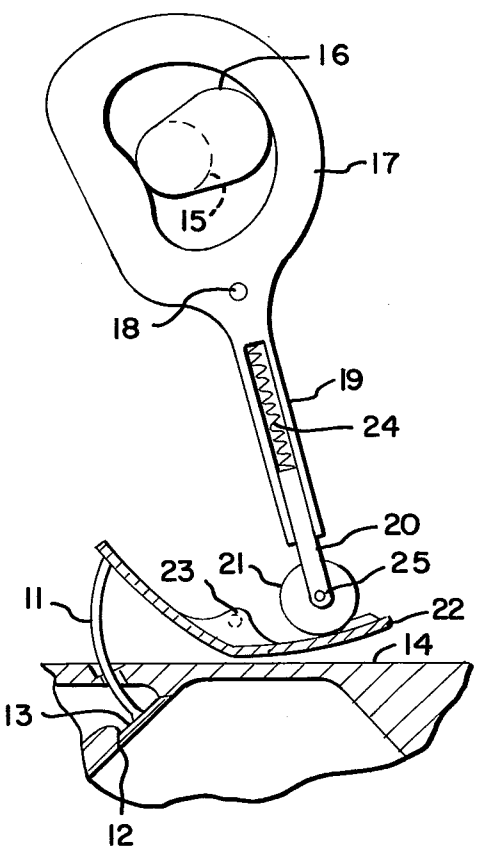
Figure 5:
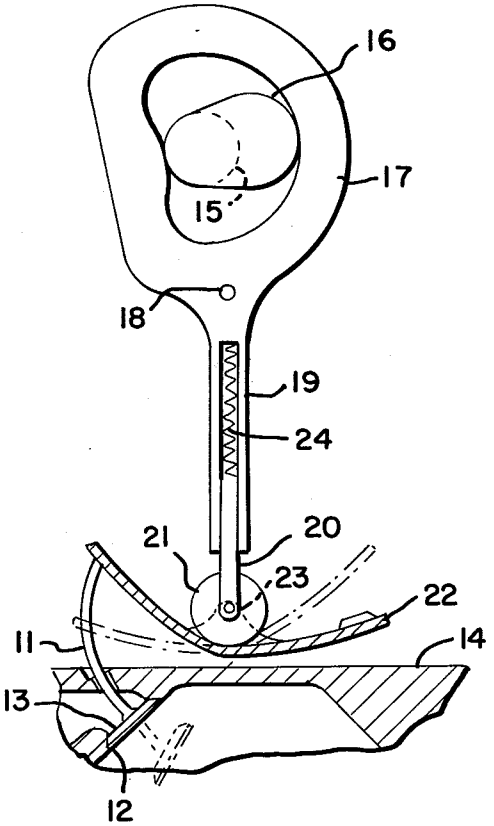
Figure 4:
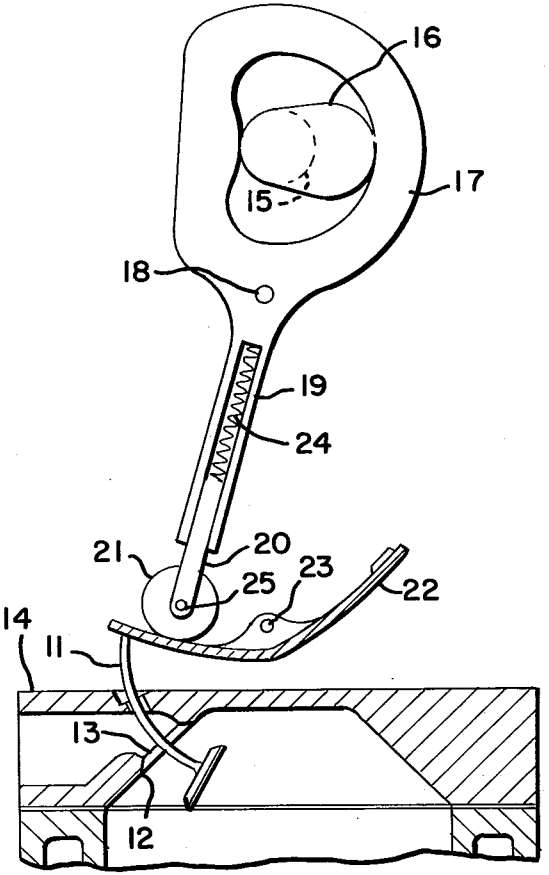

FIGS. 4, 5, and 6 are diagramatic representations illustrating the action of a spring-biased plunger means against a valve-actuating rocker platen and the subsequent novel snap action provided thereby.

The present invention may be described as a valve train for an internal combustion engine comprising a valve- actuating rocker platen, a pivot member pivotally supporting said rocker platen so that said platen may pivot between positions on either side of said member, a valve connected to one end of said rocker platen for movement simultaneously with movement of said rocker platen between said rocker platen positions, and actuator means for moving said rocker platen between said positions to positively move said valve between its open position and its closed position, said actuator means comprising rotary cam means and cooperating follower pivotally mounted and spring-biased into engagement with said rocker platen and engaged with said cam means for pivoting said rocker arm upon rotation of said cam means, said follower comprising a pivotally mounted casing, spring-biased plunger means on said casing and further biased and attached to a roller bearing on and adapted to ride over said rocker platen to thereby move said rocker platen between said positions, said roller rotatably attached to said pivoted plunger means at said roller's center of gravity, the improvement wherein said platen is mounted to said pivot member at a point above the surface on which said roller rides and further wherein the radius of said roller equals the vertical distance from said platen to said point of mounting to said pivot member so that the center of rotation of said roller passes through the axis of the pivot point of said platen. The present invention may be further characterized in that the valve-actuating rocker platen comprises two intersecting arc-shaped sections, the platen constructed such that each of said sections has the pivot point of the actuator means as its center of curvature when the spring-biased plunger means is engaged with the respective section of the platen.

In a preferred embodiment, the invention is utilized in conjunction with a positively operated overhead cam shaft valve train for an internal combustion engine. Other uses of the present invention in connection with valve trains of internal combustion engines will be apparent to those skilled in the art.

Referring now to the preferred embodiment, a poppet valve 11 is supported for reciprocation into and out of an annular valve seat 12 of either an intake or exhaust port 13 of an internal combustion engine. The valve seat 12 is formed in a cylinder head 14 for controlling the flow through port 13. A cam shaft assembly 15 is journaled for rotation in the cylinder head assembly 14 in any known manner. The cam shaft has an opening cam 16 which cooperates with a follower 17 pivotally mounted at 18.

The cooperating follower 17 comprises a casing 19 pivotally mounted at 18. The follower further comprises a spring-biased plunger means 20 on the casing and biased against and to a roller 21. By means of the plunger means 20, the roller 21 is biased to and against the track of a valve actuating rocker platen 22 pivotally mounted at 23. The point of pivotal mounting 23 additionally is the center of rotation of the roller whenever the center of the roller passes through a vertical plane through the point of pivotal mounting. This aspect comprises one of the novel features of the present invention.

The drawings illustrate the already described novel feature of the present invention and additionally another. With particular reference to FIGS. 4, 5, and 6 the driver in the form of a roller 21 bears on and is adapted to ride over the valve-actuating rocker platen 22. Platen 22 comprises a pair of arc-shaped joined at their ends to form a continuous track for accomodating the operation of the roller 21. Roller 21 is resiliently urged into contact on the curved platen by the compression spring 24. The roller 21 may be caused to move from one end of the platen 22 to the other end thereof by pivotal movement of the pivoted casing 19 between the two positions of FIGS. 4 and 6, and through the transitional position of FIG. 5. So long as roller 21 bears on that half of platen 22 to the right as shown in FIG. 6 of a center plane extending through the pivot point 23, spring 24 will act to maintain platen 22 in a position maintaining poppet valve 11 in a closed position. Simultaneously with the movement of roller 21 across and through said center plane by movement of the casing 19 from the position in FIG. 6, to that of FIG. 4, the valve-actuating rocker platen will be snapped into its lefthand contact position forcing poppet valve 11 into an open position.

One novel feature of the present invention is that the radius of roller 21 is such that its center of rotation coincides with and passes through the axis of rotation passing through 23 of the valve-actuating rocker platen 22 as the roller 21 transfers from the right arc-shaped section to the left arc-shaped section of the platen 22 as illustrated in FIG. 5. In the embodiment shown in the drawings, the center of rotation 25 passes through a line, the axis of pivot through the pivotal mounting 23 of the valve-actuating rocker platen 22.

It has been found that this particular configuration facilitates the snap action of the poppet valve 11 and moreover results in a minimum compression and/or extension of biasing spring 24.

Another feature of this invention is that the point of pivotal mounting 18 of cooperating follower 17 or casing 19 is a center of curvature for the arc of the platen section on which the roller 21 is biased at any particular point of time. It has been found with this configuration that the roller 21 may move along the platen section without causing spring 24 to extend or compress. It has been found that by utilization of this feature and/or that described in the preceding paragraph, a device is provided that operates with a minimum of actuation force to provide a maximum of contact force. The present invention provides a device that is surprisingly energy efficient. Although the device of the present invention finds utility in any instance in which a cam operated poppet valve or light valve may be employable, it is particularly useful as the operating mechanism of the overhead cam valve train described in reference to the drawings. It is in this application that the present invention results in its greatest advantage. In this particular application it has been found that when closed the poppet valve is firmly seated through the derivation of large amounts of contact forces from small amounts available actuation energy provided through the mechanism of the present invention.

The present invention may also be described as an improvement to a valve train comprising a cylinder head and poppet valve thereon, a valve-actuating rocker platen pivotally mounted on said cylinder head by means of a pivot member so that said platen may pivot between positions on either side of said member, a valve connected to one end of said rocker platen for movement of said valve simultaneously with movement of said rocker platen between said rocker platen positions, and actuator means for moving said rocker platen between said positions thereby positively moving said valve between its open position and its closed position, said actuator means comprising rotary cam means and cooperating follower pivotally mounted and spring-biased into engagement with said rocker platen and engaged with said cam means for pivoting said rocker arm upon rotation of said cam means, said follower comprising a pivotally mounted casing, spring-biased plunger means on said casing and biased to a roller bearing on and adapted to ride over said rocker platen to move said platen between said positions, the roller rotatably attached to the pivoted plunger means at the roller center of rotation.

In the description of the improvement, the platen is pivotally mounted at a point above the surface on which the roller rides, and further, the radius of the roller equals the vertical distance from the platen to the point of pivotal mounting so that the center of rotation of the roller passes through the axis of the pivot point of the platen. The valve-actuating rocker platen may comprise two intersecting arc-shaped sections, said platen so constructed that each of the sections has the pivot point of the pivoted casing as its center of curvature when the spring-biased plunger means is engaged with the respective section. It has been found that valves utilizing one or both of these described improvements operate with a maximum amount of seating force with a minimum amount of actuating energy to provide an energy- efficient and leak-proof operating valve.

As noted above, the valve gear and associated valve train of the present invention represents an energy-saving device as compared to conventional and similar valve trains of the prior art. Although it is preferred that the present invention incorporate both the novel features described, a device with either of the features will show energy savings over prior art devices. With prior art devices, and in reference to FIG. 4, as the valve is actuated the spring 24 will utilize a certain amount of energy in compression as it moves toward the configuration shown in FIG. 5. However, it has been found in accordance with the present invention that the compression of the spring is minimized so long as the valve-actuating rocker platen 22 is formed so that it comprises two intersecting arc-shaped sections having the pivot point of the pivoted lever 19 as their respective centers of curvature.

Some compression will occur as the roller 21 passes from one section to another. However, this compression and subsequent loss of energy is minimized by the second feature of the present invention, whereby the radius of the roller 21 equals the vertical distance from the platen to its point of pivotal mounting 23, as shown in FIG. 5, so that the center of rotation of said roller passes through the axis of the pivot point of the platen. In view of the above, it will be seen that the several objects of the invention are achieved and other advantageous results obtained.

It should be understood that the invention is not limited to its application to the details of construction and arrangements of parts as illustrated in the accompanying drawings (except insofar as the points of novelty are illustrated thereby), since the invention is capable of other embodiments and of being practiced or being carried out in various ways. Also, it should be understood that the phaseology or terminology employed herein is for the purpose of description and not of limitation,.

As numerous changes could be made in the described structures without departing from the scope of the invention, it is intended that all elements contained in the above descriptions or shown in the drawings shall be interpreted as illustrative and not in a limiting sense. And, it is also intended that the appended claims shall cover all such equivalent variations as come within the true spirit and scope of the invention.

What is claimed is:

1. An improvement to a valve train comprising a cylinder head and poppet valve thereon, a valve-actuating rocker platen pivotally mounted on said cylinder head by means of a pivot member so that said platen may pivot between positions on either side of said member, a valve connected to one end of said rocker platen for movement of said valve simultaneously with movement of said rocker platen between said rocker platen positions, and actuator means for moving said rocker platen between said positions thereby positively moving said valve between its open position and its closed position, said actuator means comprising a rotary cam means and cooperating follower pivotally mounted and spring-biased into engagement with said rocker platen and engaged with said cam means for pivoting said rocker arm upon rotation of said cam means, said follower comprising a pivotally mounted casing, spring-biased plunger means on said casing and biased to a roller bearing on and adapted to ride over said rocker platen thereby to move said platen between said positions, the roller rotatably attached to the pivoted plunger means at the roller center of rotation; the improvement wherein the platen is pivotally mounted at a point above the surface on which the roller rides and further, the radius of the roller equals the vertical distance from the platen to the point of pivotal mounting so that the center of rotation of the roller passes through the axis of the pivot point of said platen.

2. The valve train of claim 1 wherein the improvement additionally comprises a valve-actuating rocker platen comprising two intersecting arc-shaped sections, said platen so constructed that each of said sections has the pivot point of the pivoted casing as its center of curvature when the spring-biased plunger means is engaged with the respective section.

* * * * *